US005203870A

United States Patent [19]

Kayanuma et al.

[11] Patent Number: 5,203,870

[45] Date of Patent: Apr. 20, 1993

[54] METHOD AND APPARATUS FOR DETECTING ABNORMAL STATE OF EVAPORATIVE EMISSION-CONTROL SYSTEM

[75] Inventors: Nobuaki Kayanuma, Gotenba; Kenichi Uchida; Takayuki Otsuka, both of Susono, all of Japan

[73] Assignee: Toyota Jidosha Kabushiki Kaisha, Toyota, Japan

[21] Appl. No.: 721,687

[22] Filed: Jun. 26, 1991

[30] Foreign Application Priority Data

Jun. 28, 1990 [JP] Japan ..... 2-168522
Jun. 29, 1990 [JP] Japan ..... 2-170225
Oct. 15, 1990 [JP] Japan ..... 2-275609

[51] Int. Cl.[5] ..... F02M 39/00
[52] U.S. Cl. ..... 123/198 D; 123/520
[58] Field of Search ..... 123/516, 518, 519, 520, 123/521, 198 D, 479

[56] References Cited

U.S. PATENT DOCUMENTS 4,318,383 3/1982 Iritani et al. ..... 123/520
4,338,905 7/1982 Urich ..... 123/518
4,671,107 6/1987 Chiesa et al. ..... 73/118.2
4,846,135 7/1989 Tiphaine ..... 123/520
4,867,126 9/1989 Yonekawa et al. ..... 123/520
4,901,702 2/1990 Beicht ..... 123/520
4,949,695 8/1990 Uranishi ..... 123/198 D
4,962,744 10/1990 Uranishi et al. ..... 123/520
5,021,071 6/1991 Reddy ..... 123/518
5,067,469 11/1991 Hamburg ..... 123/458

FOREIGN PATENT DOCUMENTS 0185966 10/1983 Japan ..... 123/520
63-186955 8/1988 Japan .
1-125552A 5/1989 Japan .
2-026754 2/1990 Japan .
2-130256A 5/1990 Japan .
2-136558 5/1990 Japan .

*Primary Examiner*—Carl Stuart Miller
*Attorney, Agent, or Firm*—Kenyon & Kenyon

[57] ABSTRACT

In an evaporative emission-control system having a canister for trapping a fuel-vapor evaporated from the fuel tank and a purge control valve for executing a purging, an amount of fuel-vapor trapped in the canister is measured while the engine is stopped or in an idle state. The trapped fuel-vapor is purged from the canister and mixed with an air-fuel mixture when the amount of fuel-vapor trapped in the canister is sufficient for diagnosis while the vehicle is running in a predetermined driving condition. In this purge operation, a concentration of a vapor-laden air from the canister is measured and the occurrence of an abnormal state of the evaporative emission-control system is determined when a change of the concentration of the vapor-laden air after the purging is less than a predetermined value.

24 Claims, 14 Drawing Sheets

| Fig.4A | Fig.4B |
|---|---|

| Fig.8A | Fig.8B |
|---|---|

METHOD AND APPARATUS FOR DETECTING ABNORMAL STATE OF EVAPORATIVE EMISSION-CONTROL SYSTEM

BACKGROUND OF THE INVENTION

1. Field of the Invention

The present invention relates to a method and apparatus for detecting an abnormal state of an evaporative emission-control system having a canister containing an adsorbent and disposed between a fuel tank and an intake air passage.

2. Description of the Related Art

Generally, modern automobiles are equipped with an evaporative emission-control system having a canister filled with an adsorbent such as an activated charcoal, for trapping fuel vapor (HC) from a fuel tank and preventing an escape thereof to the open air. Fuel-vapor is caused by evaporation, and a large part of the atmosphere in the fuel tank is composed of fuel-vapor. In the evaporative emission-control system, fuel-vapor from the fuel tank flows to the charcoal canister, the charcoal particles adsorb and retain the fuel-vapor, and when the engine is run and a negative pressure is generated downstream of a throttle valve, air flows through the charcoal canister on the way to the intake air system, e.g., intake air pipe, due to the negative pressure. This intake air picks up the fuel-vapor trapped in the canister and carries it to the intake air pipe, where it is mixed with the air-fuel mixture, fed to the engine and burned, instead of being allowed to enter the atmosphere as fuel-vapor.

In this evaporative emission-control system, when a purge operation is carried out, i.e., when the fuel-vapor trapped in the canister is removed by the air drawn in by the intake-manifold vacuum, and a vapor-laden air (a purged gas) is mixed with the air-fuel mixture, an air-fuel ratio of the engine is changed in accordance with the purged gas density. Accordingly, it is necessary for the evaporative emission-control system to adjust an air-fuel ratio correction coefficient FAF in accordance with the amount of fuel-vapor purged from the canister when the purge operation is carried out. An air-fuel ratio correcting apparatus for the evaporative emission-control system is, for example, disclosed in Japanese Unexamined Patent publication No. 63-186955, wherein an an amount of fuel injection is corrected in accordance with an amount of fuel-vapor assumed by calculating a center value of the control of the air-fuel ratio correction coefficient FAF at an idling state and at a light load state.

If the amount of fuel-vapor purged from the canister of the evaporative emission-control system is not accurately calculated, the air-fuel ratio feedback control of the engine is not normally operated and the emission characteristics and the fuel consumption of the vehicle will be worsened.

As a countermeasure to cope with an above-described problem in the air-fuel feedback control system, an apparatus for detecting an abnormal state of the evaporative emission-control system has been proposed. For example, an apparatus which diagnoses whether or not the evaporative emission-control system is operating correctly by examining a change in the air-fuel ratio between an ON and OFF of the execution of the purge operation while the engine is running, has been proposed.

In this abnormal state detecting apparatus, a diagnosis of the evaporative emission-control system is carried out by detecting whether or not the air-fuel ratio becomes rich when the purge operation is executed, since if the evaporative emission-control system is normal and the fuel-vapor from the fuel tank is properly trapped in the canister, the air-fuel ratio becomes rich when the purge operation is executed. Namely, an incorrect operation of the evaporative emission-control system is detected by the abnormal state detecting apparatus when the change of the air-fuel ratio between an ON and OFF of the execution of the purge operation is smaller than a predetermined value.

Nevertheless, in the above-described abnormal state detecting apparatus, the evaporative emission-control system is erroneously detected to be abnormal when the fuel-vapor is not properly trapped in the canister or the concentration of the purged gas from the canister is equal to the stoichiometric air-fuel ratio.

Further, there has been proposed another type of abnormal state detecting apparatus having a sensor such as a pressure sensor or an air-flow sensor for detecting a flow of the vapor-laden air in a purge pipe connecting the canister and the air intake passage, and determining an abnormal state of the evaporative emission-control system in accordance with the output signal of the sensor when the purge operation is executed.

This type of the abnormal state detecting apparatus, however detects only the amount of air flow in the purge pipe and cannot detect whether or not the air flowing in the purge pipe includes fuel-vapor. Namely, if the fuel-vapor from the fuel tank cannot be trapped in the canister because of a malfunction thereof, the above-described apparatus detects that the purge system is normal and the incorrect operation of the canister cannot be detected.

SUMMARY OF THE INVENTION

An object of the present invention is to provide a method and apparatus for detecting an abnormal state of the evaporative emission-control system of an internal combustion engine, which can prevent a misdetection of a normal or an abnormal state of the evaporative emission-control system even if only a small amount of the fuel-vapor is trapped in the canister, the concentration of the purged gas is equal to the stoichiometric air-fuel ratio, or the canister is not functioning correctly.

According to the present invention, in an abnormal state detecting system of an evaporative emission-control system in which a fuel-vapor evaporated from the fuel tank is temporarily trapped in a canister when an internal combustion engine is stopped or in an idle state, the trapped fuel-vapor is purged from the canister by a vacuum in an air-intake passage of the engine, and the purged fuel-vapor is mixed with an air-fuel mixture to be burned in combustion chamber when the vehicle is running in a predetermined driving condition, an amount of the fuel-vapor trapped in the canister is detected, the fuel-vapor trapped in the canister is purged and mixed with the air-fuel mixture in an air-intake passage when the purge condition is satisfied, a concentration of a vapor-laden air from the canister is detected, the occurrence of an abnormal state of the evaporative emission-control system is determined when a change of the concentration of the vapor-laden air from the canister after the purging is lower than a predetermined value, and the purging is prohibited when the amount of the fuel-vapor trapped in the canister is detected to be less than a predetermined amount.

BRIEF DESCRIPTION OF THE DRAWINGS

The present invention will be more clearly understood from the description set forth below with reference to the accompanying drawings, wherein.

DESCRIPTION OF THE PREFERRED EMBODIMENTS

Figure 1:
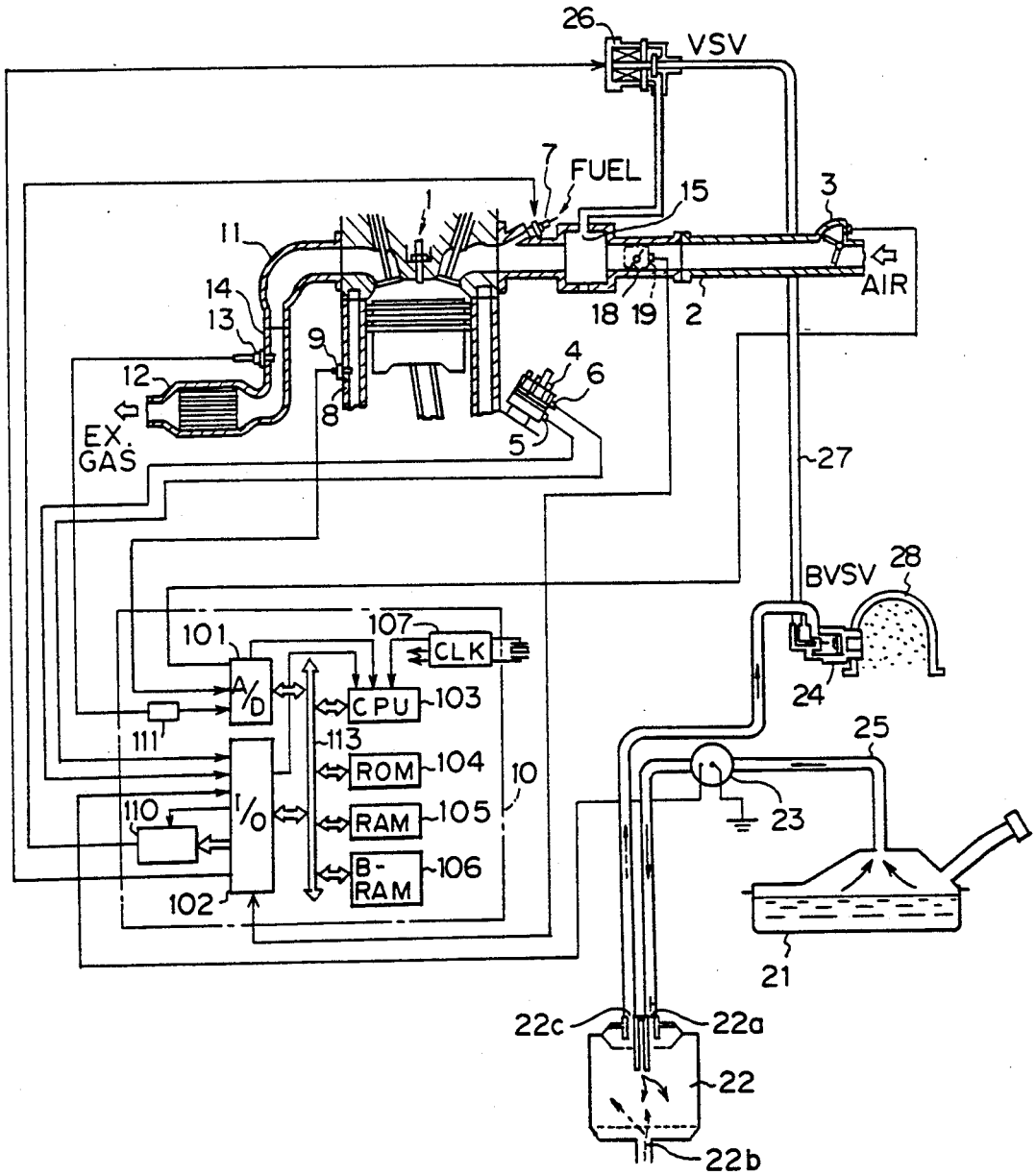
FIG. 1 is a schematic view of an internal combustion engine having an abnormal state detecting system of an evaporated emission-control system according to one embodiment of the present invention.

In FIG. 1, which illustrates an internal combustion engine according to the present invention, reference numeral 1 designates a four-cycle spark ignition engine disposed in an automotive vehicle, and provided in an air-intake passage 2 of the engine 1 is a potentiometer-type airflow meter 3 for detecting the amount of air taken into the engine 1, to thereby generate an analog voltage signal in proportion to the amount of air flowing therethrough. The signal from the airflow meter 3 is transmitted to a multiplexer incorporating analog-to-digital (A/D) converter 101 of a control circuit 10.

Also provided in the air-intake passage 2 downstream of the airflow meter 3 are a throttle valve 18 having an idling position switch 19 mounted at the shaft thereof, and a fuel injection valve 7 for supplying pressurized fuel from the fuel tank 21 to the air-intake port of the cylinder of the engine 1. Note, the idling switch 19 detects whether or not the throttle valve 18 is completely closed, i.e., in an idling position, to generate an idle signal which is transmitted to an input/output (I/O) interface 102. Also, other fuel injection valves are provided for other cylinders, although not shown in FIG. 1.

Disposed in a distributor 4 are crank-angle sensors 5 and 6 for detecting the angle of the crankshaft (not shown) of the engine 1. In this case, the crank-angle sensor 5 generates a pulse signal at every 720° crank angle (CA) and the crank-angle sensor 6 generates a pulse signal at every 30° CA. The pulse signals of the crank-angle sensors 5 and 6 are supplied to an input-/output (I/O) interface 102 of the control circuit 10. Further, the pulse signal of the crank-angle sensor 6 is then supplied to an interruption terminal of a central processing unit (CPU) 103 to be used as a 30° CA interruption signal for calculating a rotational speed Ne of the engine and an amount of fuel injection TAU.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits the signal to the A/D converter 101 of the control circuit 10.

An $O_2$ sensor 13 is provided in an exhaust pipe 14 downstream of an exhaust manifold 11, for detecting a concentration of oxygen in the exhaust gas, and generates an output voltage signal in accordance with the air-fuel ratio and transmits it via a current-to-voltage converter circuit 111 to the A/D converter 101 of the control circuit 10. Provided in the exhaust pipe 14 on the downstream-side of the $O_2$ sensor 13 is a three-way reducing and oxidizing cayalyst converter 12, which simultaneously removes three pollutants CO, HC, and NOx from the exhaust gas.

The evaporative emission-control system is provided with a canister 22 filled with activated charcoal, and the charcoal canister 22 has three openings **22*a*, 22*b*, and 22*c*. The opening 22*a* is connected to an upper part of the fuel tank 21 by a vapor vent pipe 25 having a vapor flow switch 23; the opening 22*b* is open to the atmosphere; and the opening 22*c* is linked to a purge port 15 via a purge pipe 27 having a water temperature valve (BVSV) 24 and a electrically controlled purge valve (VSV) 26. The water temperature valve (BVSV) 24 is an ON/OFF type valve which is mounted on the wall of the coolant pool 28 and is opened when the temperature of the coolant becomes higher than a predetermined value. The electrically controlled purge valve (VSV) 26 is also an ON/OFF type solenoid valve and is opened or closed in accordance with singals from the control circuit 10. When fuel-vapor exists in the fuel tank 21, the fuel vapor is passed through the vapor vent pipe 25, thus making the vapor flow switch 23 ON, and into the canister 22** where it is trapped by the activated charcoal.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), and constants, etc., a random access memory 105 (RAM) for storing temporary data, a backup RAM 106, a clock generator 107 for generating various clock signals, a drive circuit 110 including a down counter, and a flip-flop for driving the injection valve 7 and the like.

Note that the battery (not shown) is connected directly to the backup RAM 106 and, therefore, the content thereof is not erased even when the ignition switch (not shown) is turned off.

The drive circuit 110 is used for controlling the fuel injection valve 7, i.e., when a fuel injection amount TAU is calculated in a TAU routine, the amount TAU is preset in the down counter, and simultaneously, the flip-flop is set, and as a result, the drive circuit 110 initiates the activation of the fuel injection valve 7. Further, the down counter counts up the clock signal from the clock generator 107, and finally generates a logic "1" signal from the carry-out terminal thereof, to reset the flip-flop, so that the drive circuit 110 no longer activates the fuel injection valve 7, and thus an amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 109 generates a special clock signal.

The intake air amount data Q of the airflow meter 3 and the coolant temperature data THW are fetched by an A/D conversion routine(s) executed at predetermined intervals, and are then stored in the RAM 105; i.e., the data Q and THW in the RAM 105 are renewed at predetermined intervals. The engine speed Ne is calculated by an interrupt routine executed at 30° CA, i.e., at every pulse signal of the crank angle sensor 6, and then stored in the RAM 105.

Figure 2:
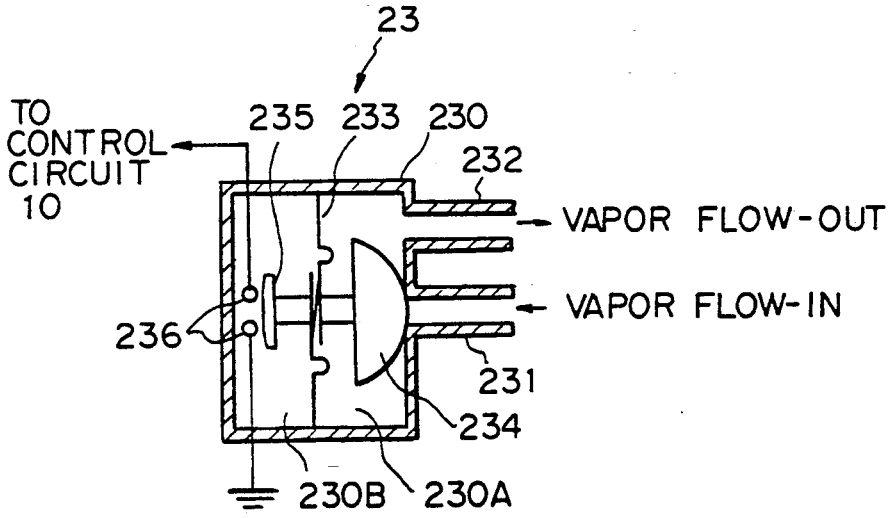
FIG. 2 is a sectional view of a flow switch as shown in FIG. 1.

FIG. 2 shows a detailed construction of the flow switch 23 according to one embodiment of the present invention as shown in FIG. 1. The flow switch 23 consists of a casing 230, an inlet port 231 connected to the fuel tank 21, for a flow-in of fuel vapor, an outlet port 232 connected to the canister 22, for a flow-out of fuel-vapor, a diaphragm 233, a valve plug 234, a contact plate 235, and contact points 236, one of which is grounded and the other connected to the control circuit 10. The interior of the casing 230 is divided into two chambers 230A and 230B by the diaphragm 233, and the valve plug 234 seals the inlet port 231 and the contact points 236 are separated (OFF) in the steady state.

When the engine is stopped, the fuel in the fuel tank 21 vaporizes and the pressure of the atmosphere in the fuel tank 21 is increased. If the air pressure in the tank 21 exceeds the predetermined value, the valve plug 234 is moved towards the chamber 230B and thus the fuel-vapor from the fuel tank 21 is allowed to flow to the canister, to be trapped therein, and the contact points 236 are connected (ON) by the contact plate 235. The amount of fuel-vapor trapped in the canister 22 is calculated by the control circuit 10, by detecting the ON time of the contact points 236.

Note, the amount of fuel-vapor trapped in the canister 22 is calculated by using the flow switch 23 in the above-described embodiment, but this can be also calculated by using a flow sensor or a pressure sensor for detecting an air pressure inside the fuel tank 22.

The operation of the control circuit 10 of FIG. 1 will be explained with reference to the flow charts of FIGS. 3, 4, and 5.

Figure 3:
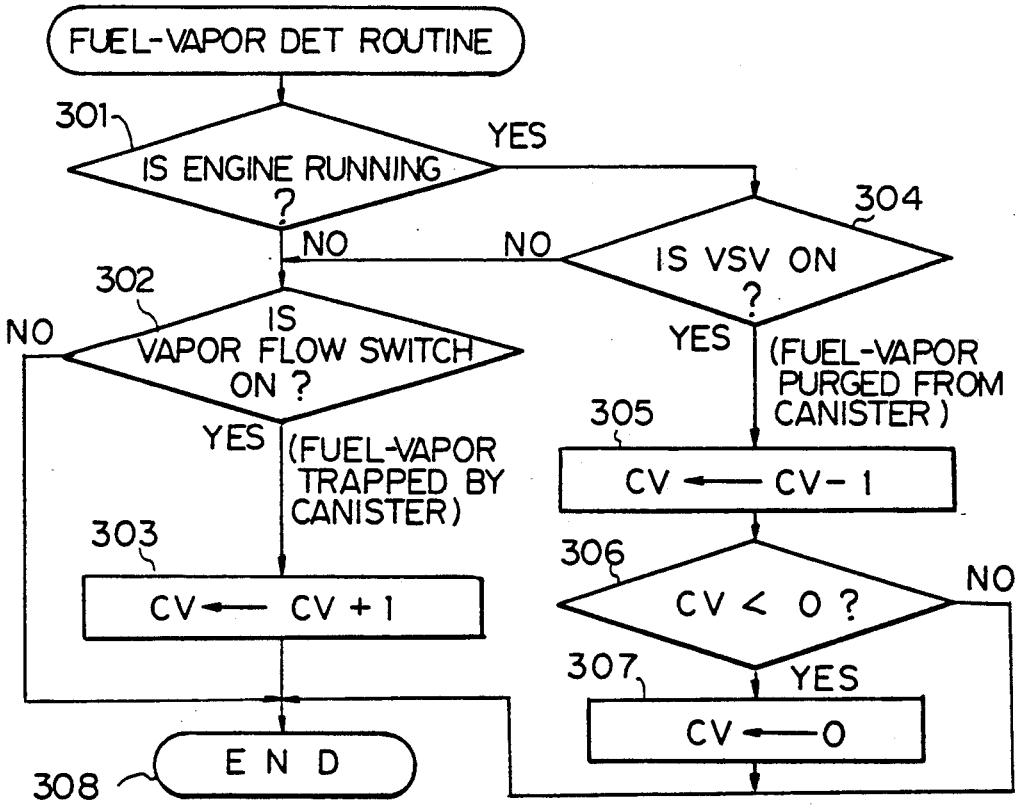
FIGS. 3, 4A, 4B, and 5 are flowcharts showing the operation of the control circuit of FIG. 1.

FIG. 3 shows a routine for detecting a generation of fuel-vapor and is executed, whether or not the engine is running, at predetermined intervals.

At step 301, it is determined whether or not the engine is running. If the engine is not running, the control proceeds to step 302 and it is determined whether or not the vapor flow switch 23 is ON. If the vapor flow switch 23 is ON, the control proceeds to step 303 and a vapor occurrence counter CV is incremented by 1, as the fuel-vapor from the fuel tank 21 is being trapped by the canister 22 when the vapor flow switch 23 is ON. Conversely, if the vapor flow switch 23 is not ON, the control proceeds to step 308 and this routine is ended.

Further, if it is detected that the engine is not running at step 301, the control proceeds to step 304 and it is determined whether or not the electrically-controlled purge valve (VSV) 26 is ON. If the electrically-controlled purge valve (VSV) 26 is not ON, the control proceeds to step 302 and the previously described steps 302, 303, and 308 are executed. If the electrically-controlled purge valve (VSV) 26 is ON at step 304, the control proceeds to step 305 and the vapor occurrence counter CV is decremented by 1, as the fuel-vapor from the fuel tank 21 is being purged from the canister 22 when the electrically-controlled purge valve (VSV) 26 is ON. Steps 306 and 307 are used for guarding the value of the counter CV at a negative value, whereby, if the value of the counter CV is smaller than zero at step 306, the control proceeds to step 307 and the value of zero is set in the counter CV. This routine is completed at step 308 after the execution of step 306 or step 307.

Figures 4, 4A:
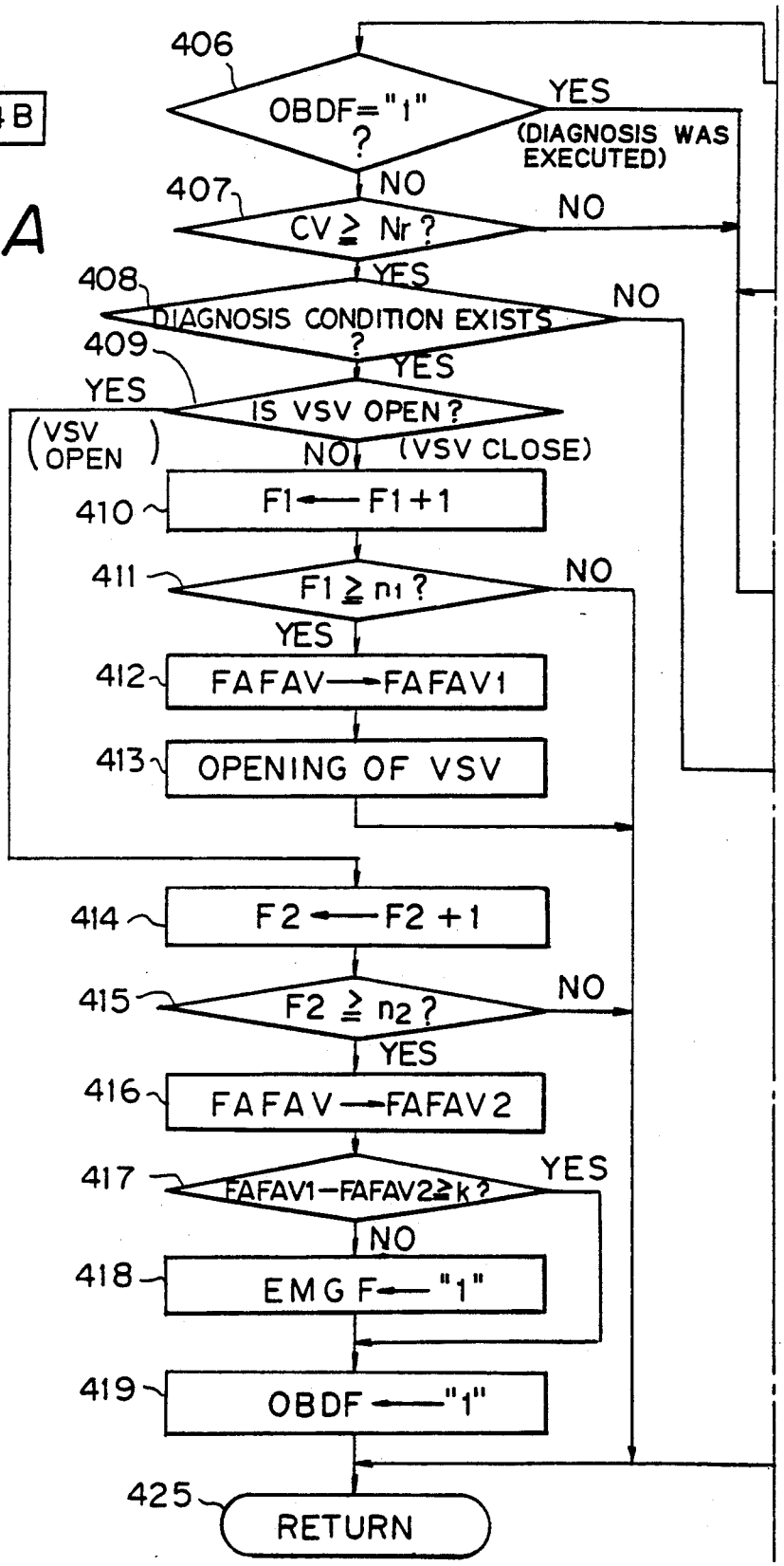
Figure 4B:
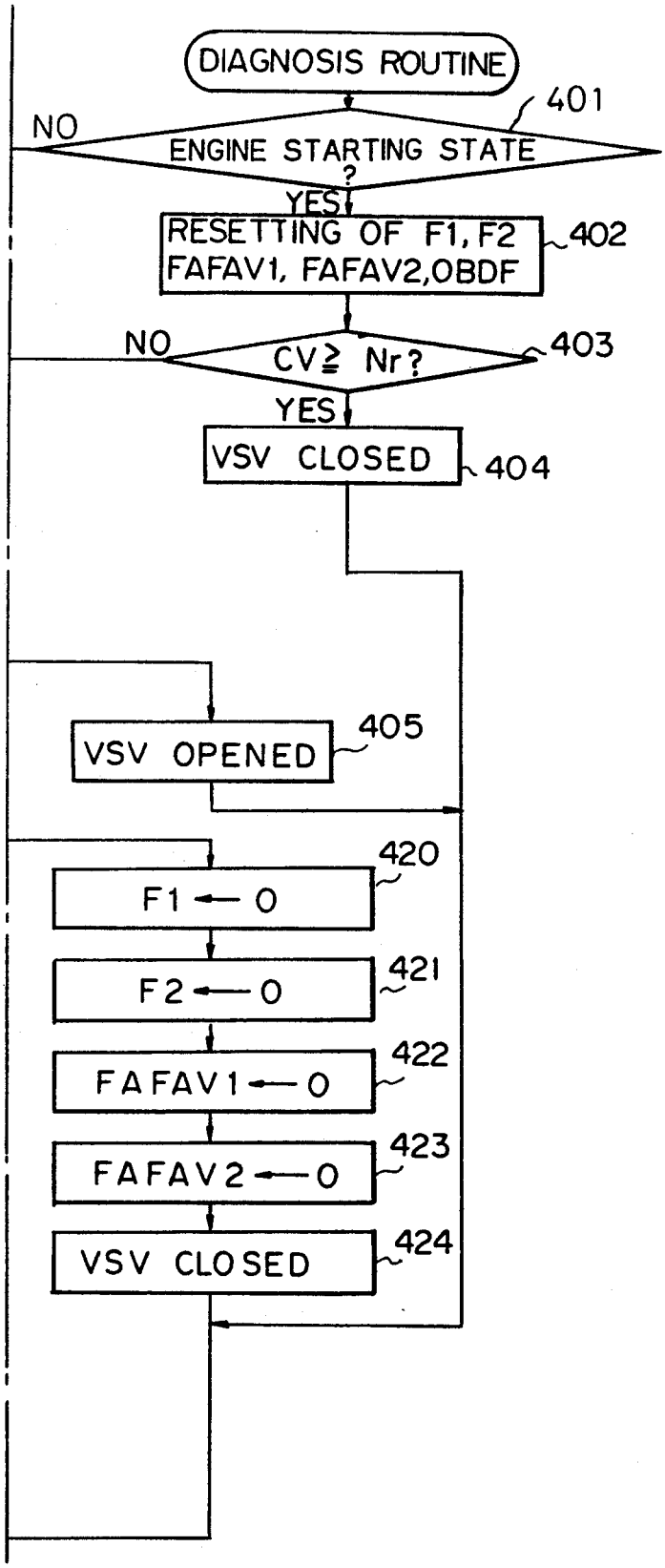

FIGS. 4A and 4B show a routine, for detecting an abnormal state of the evaporative emission-control system, which is executed at predetermined intervals such as every 4 ms.

Steps 401 through 404 are a control routine carried out when the engine is in a starting state. Namely, at step 401 it is determined whether or not the engine is in the starting state, and if the engine is in the starting state, the control proceeds to step 402 and counters F1 and F2, memories FAFAV1 and FAFAV2, and a diagnosis end flag OBDF, explained later, are reset. Then, at step 403, it is determined whether the value of the vapor occurrence counter CV is larger than or equal to the reference value Nr. If $CV \geqq Nr$, which means the fuel-vapor is properly trapped in the canister, the control proceeds to step 404 and the electrically-controlled purge valve (VSV) 26 is closed to carry out the diagnosis of the evaporative emission-control system as explained later. If $CV < Nr$, the control proceeds to step 405 and the electrical-controlled purge valve (VSV) 26 is opened, as too little an amount of the fuel-vapor is trapped in the canister to carry out the diagnosis of the evaporative emission-control system.

When the engine is not being started, the control proceeds from step 401 to step 406. The steps after step 406 are the process for a diagnosis of the evaporative emission-control system when the engine is running. At step 406, it is determined whether or not the diagnosis end flag OBDF is "1". The diagnosis end flag OBDF is set to "0" at step 402 after the engine is started and the diagnosis of the evaporative emission-control system has not been executed, and is set to "1" after the execution of the diagnosis of the evaporative emission-control system. If OBDF="1" at step 406, the control proceeds to step 405, and the electrically-controlled purge valve (VSV) 26 is opned. If OBDF="0" at step 406, the control proceeds to step 407.

At step 407, it is determined whether or not the value of the vapor occurrence counter CV is larger than or equal to the reference value Nr. This reference value Nr is preferably set to a value such that it is indicated that the vapor occurrence counter CV has counted for more than 30 minutes in the routine described in FIG. 3. If $CV < Nr$, the control proceeds to step 405 and the electrically-controlled purge valve (VSV) 26 is opened, since too smaller an amount of the fuel-vapor is trapped in the canister to carry out the diagnosis of the evaporative emission-control system, and the routine is then completed at step 425. If $CV \geqq Nr$, which means that the fuel-vapor is properly trapped in the canister, the control proceeds to step 408 and it is determined whether or not a diagnosis condition for the evaporative emission-control system is satisfied.

The diagnosis condition for the evaporative emission-control system is, for example, as follows:

1) The coolant temperature is higher than 40° C.;
2) The engine is running without a fuel-cut operation;
3) The running engine is not in a transient state; and
4) The air-fuel ratio feedback control condition is satisfied.

If at least one of the above conditions is not satisfied, the control proceeds to steps 420 to 424 and the valve closed condition counter F1 is reset at step 420, the valve open condition counter F2 is reset at step 421, the memory FAFAV1 is reset at 422, the memory FAFV2 is reset at 423, the electrically-controlled purge valve (VSV) 26 is closed at step 424, ant this routine is completed at step 425.

If all of the above conditions are satisfied, the control proceeds to steps 409 to 419 to execute the diagnosis of the evaporated emission-control system. Namely, the diagnosis of the evaporated emission-control system in this embodiment is executed under the condition that an amount of fuel-vapor sufficient for a diagnosis is trapped in the canister 22. At step 409, it is determined whether or not the electrically-controlled purge valve (VSV) 26 is open. If the electrically-controlled purge valve (VSV) 26 is closed, the control proceeds to step 410, and if the electrically-controlled purge valve (VSV) 26 is open, the control proceeds to step 414.

At step 410, the valve closed condition counter F1 for counting the time after the control first proceeds to step 410 is incremented by 1, and at step 411 it is determined whether or not the value of the valve closed condition counter F1 is larger than or equal to the predetermined value $n_1$. Note, the value $n_1$ is preferably preset, for example, to a value equal to a time of 5 seconds. Accordingly, the control proceeds to step 425 and this routine is completed while the value of the counter F1 is smaller than $n_1$. If $F1 \geqq n_1$ at step 411, the control proceeds to step 412 and the average air-fuel ratio correction coefficient FAFAV is stored in the memory FAFAV1. Then at step 413, the electrically-controlled purge valve (VSV) 26 is opened and this routine is completed at step 425. The memory FAFAV1 sjtores the value of the air-fuel ratio correction coefficient FAF when fuel-vapor from the canister 22 is not mixed with the air-fuel mixture.

Conversely, if the electrically-controlled purge valve (VSV) 26 is determined to be open at step 409, the control proceeds to step 414 and the valve open condition counter F2 for counting the time after the control first proceeds to step 414 is incremented by 1. Then at step 415, it is determined whether or not the value of the valve open condition counter F2 is larger than or equal to the predetermined value $n_2$. Note, the value $n_2$ is preferably preset, for example, to a value equal to 5 seconds. Accordingly, the control proceeds to step 425 and this routine is completed while the value of the counter F2 is smaller than $n_2$. If $F2 \geqq n_2$ at step 415, the control proceeds to step 416 and the average air-fuel ratio correction coefficient FAFAV after the purge gas from the canister 22 is mixed with the air-fuel mixture is stored in the memory FAFAV2, to be compared with the value stored in the memory FAFAV1.

Then, at step 417, it is determined whether or not the average air-fuel ratio correction coefficient FAFAV in the memory FAFAV1 is larger than the same stored in the memory FAFAV2, by a predetermined value K. When the evaporated emission-control system is in a normal state, the air-fuel ratio after the electrically-controlled purge valve (VSV) 26 is open and the purge gas from the canister 22 is mixed with the air-fuel mixture becomes rich. At this time, the amount of fuel injected from the injection valve 7 is reduced to maintain the air-fuel ratio at the same value as before the purged gas is mixed therewith, and thus the average air-fuel ratio correction coefficient FAFAV becomes smaller. Accordingly, the value of the subtraction FAFAV1−FAFAV2 is higher than the predetermined value K if the evaporated emission-control system is normal. The value k is approximately 2% of the value stored in the memory FAFAF1.

Therefore, if $FAFAV1-FAFAV2 \geqq K$ at step 417, the control proceeds to step 419 and the diagnosis end flag OBDF is set to "1", but if $FAFAV1-FAFAV2 < K$ at step 417, the control proceeds to step 418 and an abnormal indication flag EMGF is set to "1". When the abnormal indication flag EMGF is set to "1", preferably a warning of the abnormal state of the evaporated emission-control system is given to the driver of the vehicle by turning on an warning lamp in the vehicle or by sounding an alarm buzzer. This routine is completed at step 425.

Figure 5:
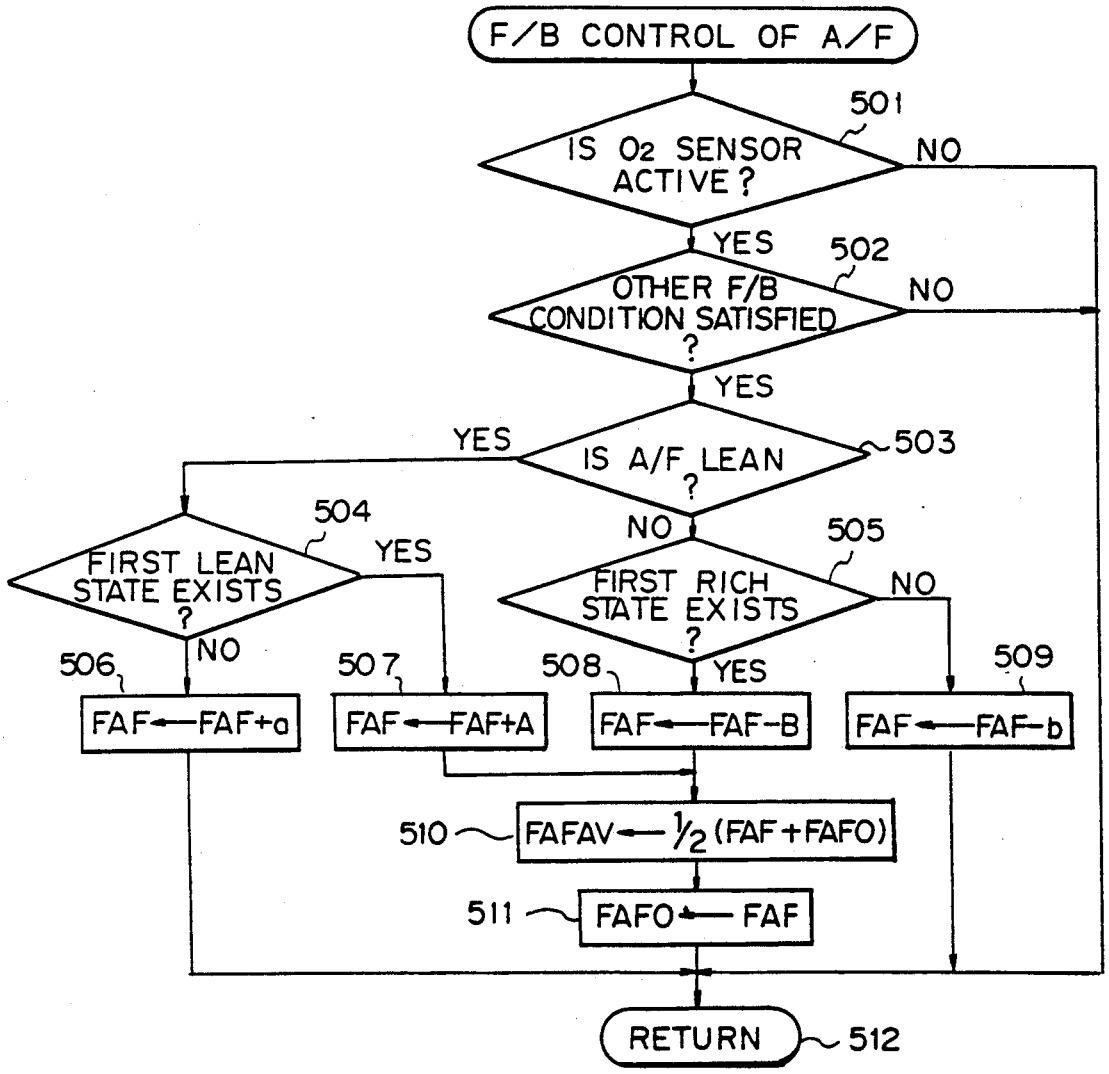

FIG. 5 is a routine for controlling the air-fuel ratio executed at predetermined intervals when the $O_2$ sensor 13 is in an active state, wherein the average air-fuel ratio feedback correction coefficient FAFAV used at steps 412 and 416 is calculated.

At step 501, it is determined whether or not the $O_2$ sensor 13 is in an active state. If the $O_2$ sensor 13 is in an active state, the control proceeds to step 502 but if the $O_2$ sensor 13 is not in an active state, the control proceeds to step 512 to complete this routine without changing the air-fuel ratio correction coefficient FAF. At step 502, it is determined whether or not the other feedback control (closed-loop control) conditions are satisfied. These control conditions are, for example, as follows:

1) The engine is not being started;
2) The incremental fuel injection is not being executed;
3) The coolant temperature is higher than a predetermined value; and
4) A fuel cut-off is not being executed. Of course, other feedback control conditions are introduced as occasion demands, but an explanation of such other feedback control conditions is omitted.

If at least one of the feedback control conditions is not satisfied, the control proceeds to step 512, to thus complete this routine. If all the feedback control conditions are satisfied, the control proceeds to step 504, and it is determined whether or not the air-fuel ratio is lean. Thid determination of whether or not the air-fuel ratio is lean is executed by the output signal from the $O_2$ sensor 13.

If the air-fuel ratio is on the lean side at step 503, the control proceeds to step 504 and it is determined whether or not the lean state is first changed from the rich state. If this is a first change for a lean state from the rich state, the control proceeds to step 507, and the coefficient FAF is increased by a relatively large amount A (a skip amount), and the control then proceeds to step 510. If this is not a first change to a lean state from the rich state, the control proceeds to step 506, and the coefficient FAF is increased by a relatively small amount a ($<<A$), and the control proceeds to step 512 to complete this routine.

If the air-fuel ratio is on the rich side at step 503, the control proceeds to step 505 and it is determined whether or not this is a first change to the rich state from the lean state. If this is a first change to the rich state from the lean state, the control proceeds to step 508, and the coefficient FAF is decreased by a relatively large amount B (a skip amount), and the control then proceeds to step 510. If this is not a first change to the rich state from the lean state, the control proceeds to step 509, and the coefficient FAF is increased by a relatively small amount b (<<B), and the control then proceeds to step 512 to thus complete this routine.

The process shown in steps 506 and 509 is an integration control, and the process shown in steps 506 and 508 is a skip control, of the air-fuel ratio. In the skip process, the control proceeds to step 510 from steps 507 and 508, and the average air-fuel ratio correction coefficient FAFAV is calculated by using the air-fuel ratio correction coefficient FAF, i.e., $$FAFAV \leftarrow \frac{1}{2}(FAF+FAFO)$$

where FAFO is an air-fuel ratio FAF of the previously executed routine. Then at step 511, the air-fuel ratio correction coefficient FAF is stored in the RAM 105 as the old coefficient FAFO, and this routine is then completed at step 512.

The operation by the flow chart of FIGS. 3 through 5 will be further explained with reference to FIGS. 6A through 6D, based on a change of the closed condition counter F1, the open condition counter F2, the electrically-controlled purge valve (VSV) 26, the air-fuel ratio correction coefficient FAF, and the average air-fuel ratio correction coefficients FAFAV, FAFAV1 and FAFAV2.

Figures 6A, 6B, 6C, 6D:
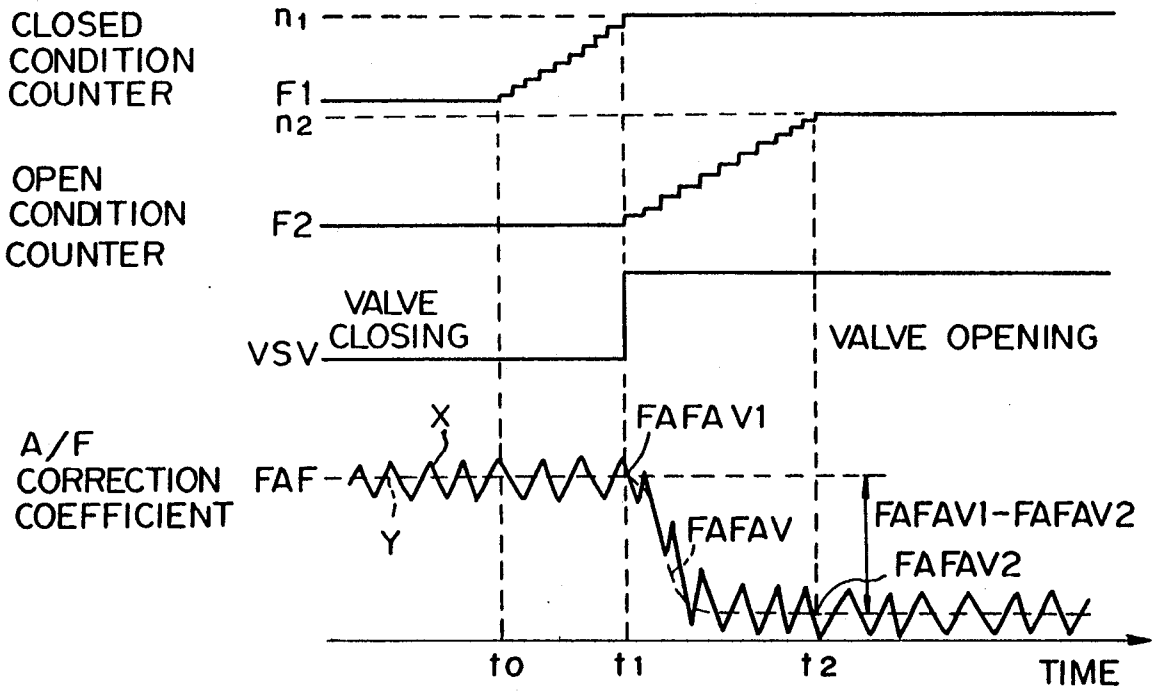
FIGS. 6A through 6D are timing diagrams explaining the flowcharts of FIGS. 3 through 5.

When the diagnosis condition of the evaporative emission-control system is satisfied at a time $t_0$, the closed condition counter F1 starts a count as shown in FIG. 6A. The air-fuel ratio correction coefficient FAF changes indicated by reference X and the average air-fuel ratio correction coefficient FAFAV are calculated as indicated by reference Y and stored in the RAM 105 as FAFAV1 when the closed condition counter F1 reaches $n_1$, as shown in FIG. 6A. When the value of the closed condition counter F1 reaches the predetermined value $n_1$, the electrically-controlled purge valve (VSV) 26 is opened, and thus the value of the closed condition counter F1 is held as shown in FIG. 6A, the open condition counter F2 starts a count as shown in FIG. 6B, and the average air-fuel ratio correction coefficient FAFAV is changed as shown in FIG. 6D. When the value of the open condition counter F2 reaches the predetermined value $n_2$, the average air-fuel ratio correction coefficient FAFAV is stored in the RAM 105 as FAFAV2, and accordingly, it is possible to execute the diagnosis of the evaporated emission-control system at the time $t_2$ in accordance with the value of FAFAV1-FAFAV2.

Therefore, in the above described embodiment, whether or not the amount of the fuel-vapor trapped in the canister 22 is sufficient for a diagnosis is detected while the engine is stopped, and thus an abnormal state of the evaporative emission-control system can be accurately detected soon after the engine is started. Further, in this embodiment, when the amount of the fuel-vapor trapped in the canister 22 is detected to be sufficient for a diagnosis while the engine is in an idle state of the engine, the diagnosis of the evaporative emission-control system is executed in the idle state wherein the amount of intake air is small, and thus the accuracy of the detection of the abnormal state of the evaporative emission-control system is increased because the change of the air-fuel ratio is large after the mixing of the purged vapor with the air-fuel mixture.

Note, as a modified embodiment, the increment of the vapor occurrence counter CV may be executed only while the engine is stopped, and if the detected amount of the fuel-vapor trapped in the canister 22 is insufficient for a diagnosis while the engine is stopped, the diagnosis of the evaporative emission-control system is not executed in that time. Further, the control circuit may operate only when the vapor flow switch 23 is ON, to lower the power consumption of the battery while the engine is stopped.

The other operation of the control circuit 10 of FIG. 1 will be explained with reference to the flow charts of FIGS. 7, 8A, and 8B.

Figure 7:
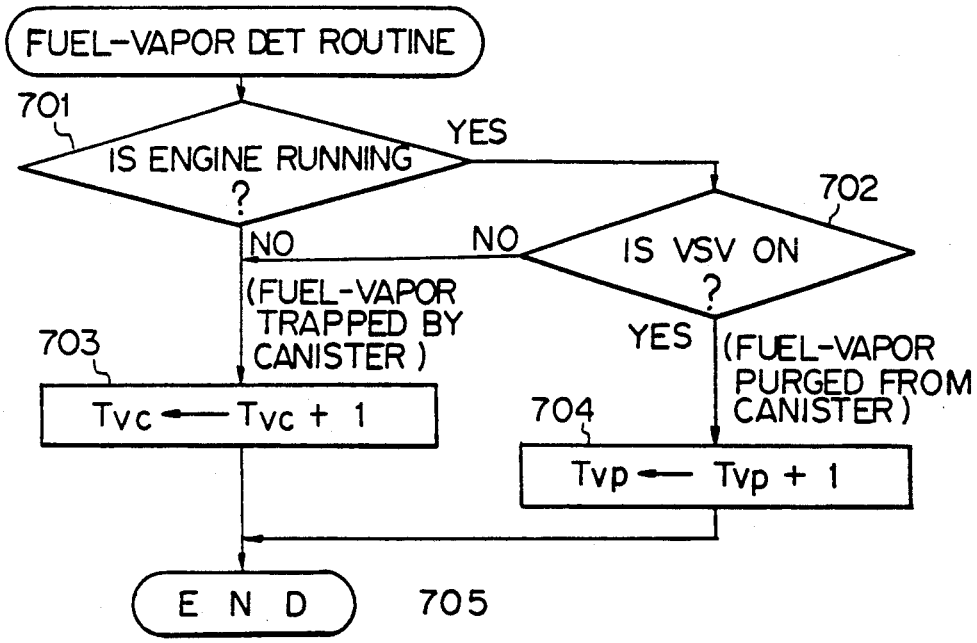
FIGS. 7, 8A and 8B are flowcharts showing another operation of the control circuit of FIG. 1.

FIG. 7 shows a routine for counting the time for which the purge operation is executed and not executed. This routine is also executed, whether or not the engine is running, at predetermined intervals, to detect the amount of fuel-vapor trapped in the canister.

At step 701, it is determined whether or not the engine is running. If the engine is not running, the control proceeds to step 702 and it is determined whether or not the electrically-controlled purge valve (VSV) 26 is ON. If the electrically-controlled purge valve (VSV) 26 is not ON, the control proceeds to step 703 to increment a vapor trapped time counter Tvc by 1, since the fuel-vapor from the fuel tank 21 is trapped by the canister 22 when the electrically-controlled purge valve (VSV) 26 is OFF. Conversely, if the electrically-controlled purge valve (VSV) 26 is ON, the control proceeds to step 704 to increment a vapor purge time counter Tvp by 1, since the fuel-vapor trapped in the canister 22 is being purged from the canister 22 when the electrically-controlled purge valve (VSV) 26 is ON. This routine is completed at step 705.

Figures 8, 8A:
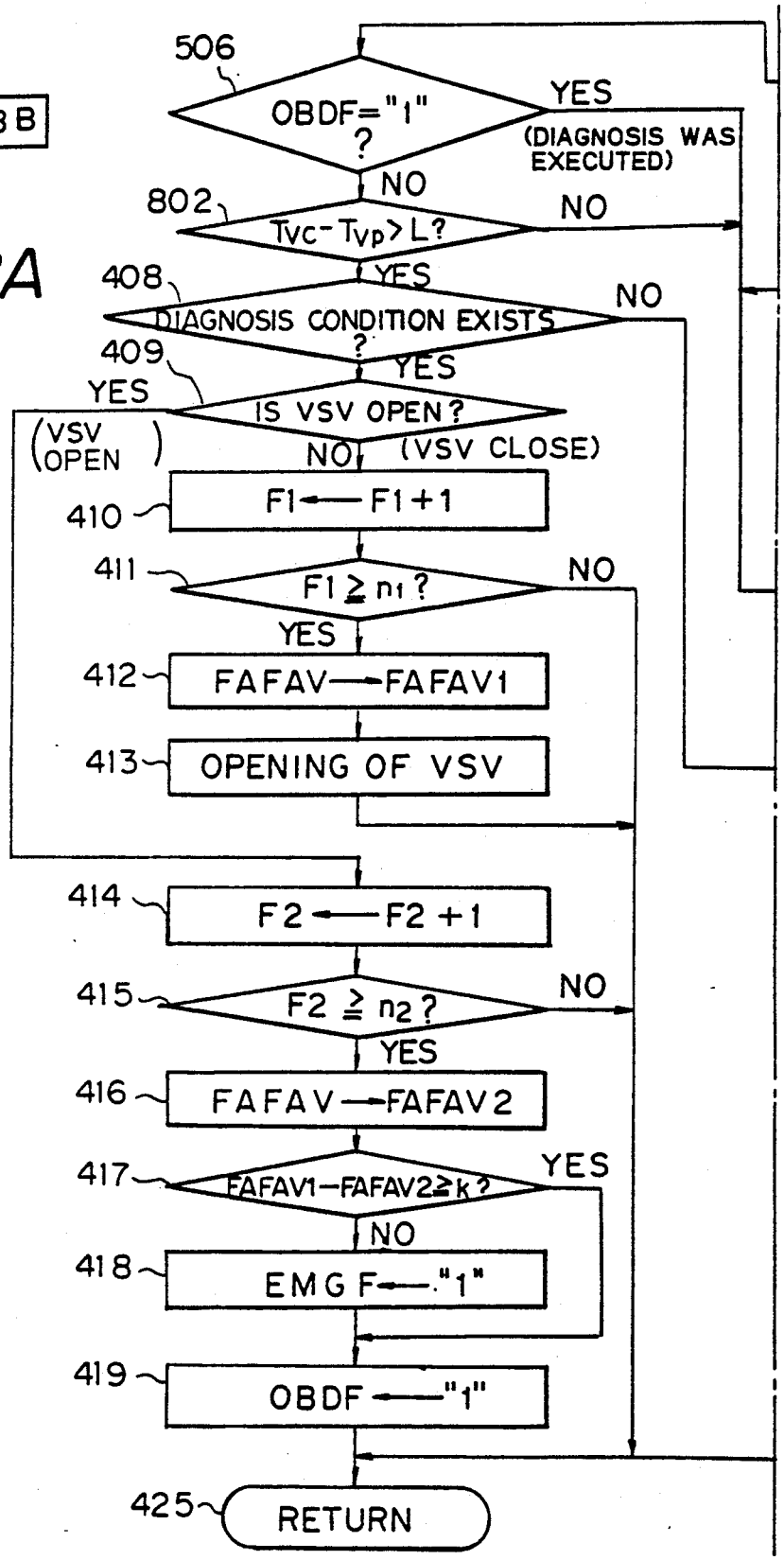
Figure 8B:
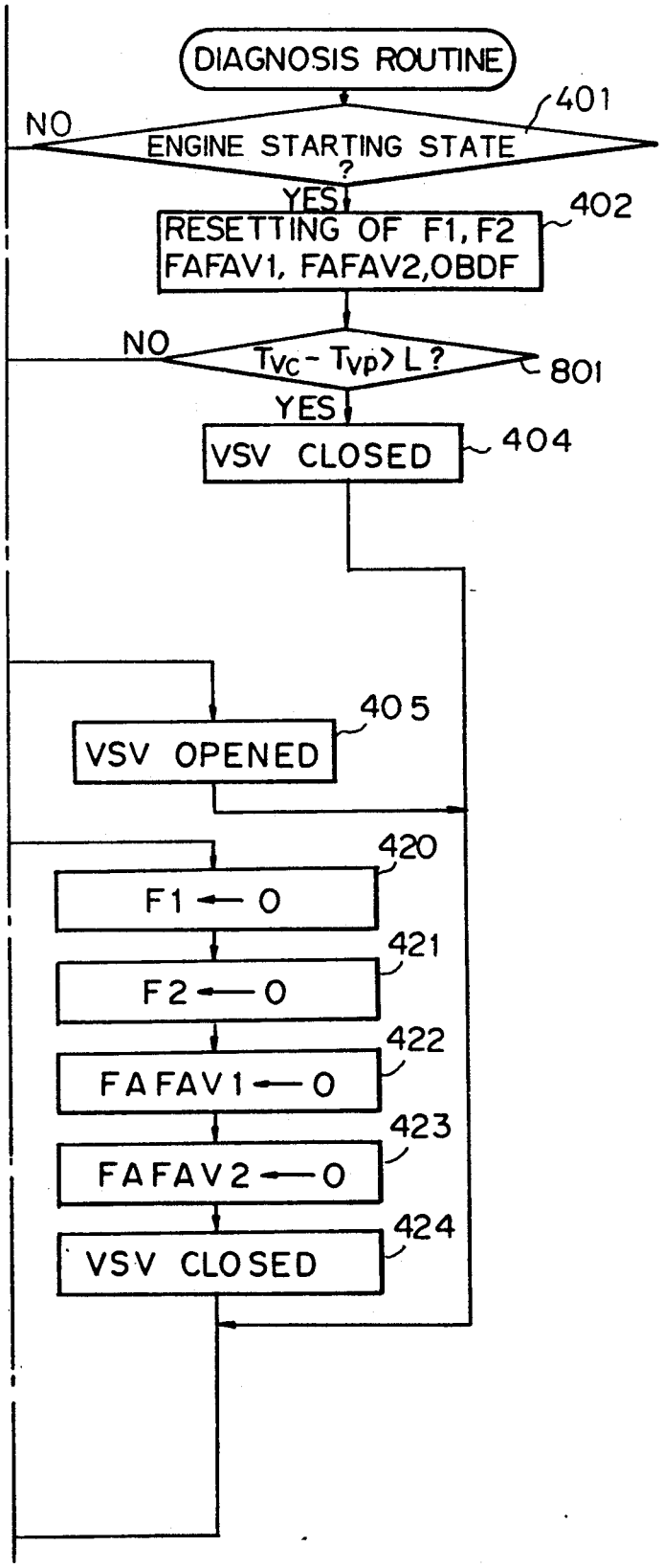

FIGS. 8A and 8B show a routine, for detecting the abnormal state of the evaporative emission-control system, executed at predetermined intervals such as every 4 ms. This routine is a modification of the flowchart shown in FIG. 4A and 4B. In FIG. 8A and 8B, only steps 803 and 808 are different; step 803 is executed instead of step 403 in FIG. 4A, and step 808 is executed instead of step 408 in FIG. 4B.

At steps 403 and 408, it is determined whether or not the time difference between the vapor trapped time counter Tvc and the vapor purge time counter Tvp is larger than the predetermined value L, which means that the time for which the fuel-vapor is trapped in the canister 22 (the time for which the purge operation is stopped) is sufficiently longer than the time for which the fuel-vapor trapped in the canister is purged (the time for which the purge operation is executed). Accordingly, in this embodiment, the diagnosis of the evaporative emission-control system is executed only when $Tvc-Tvp>L$.

Figure 9:
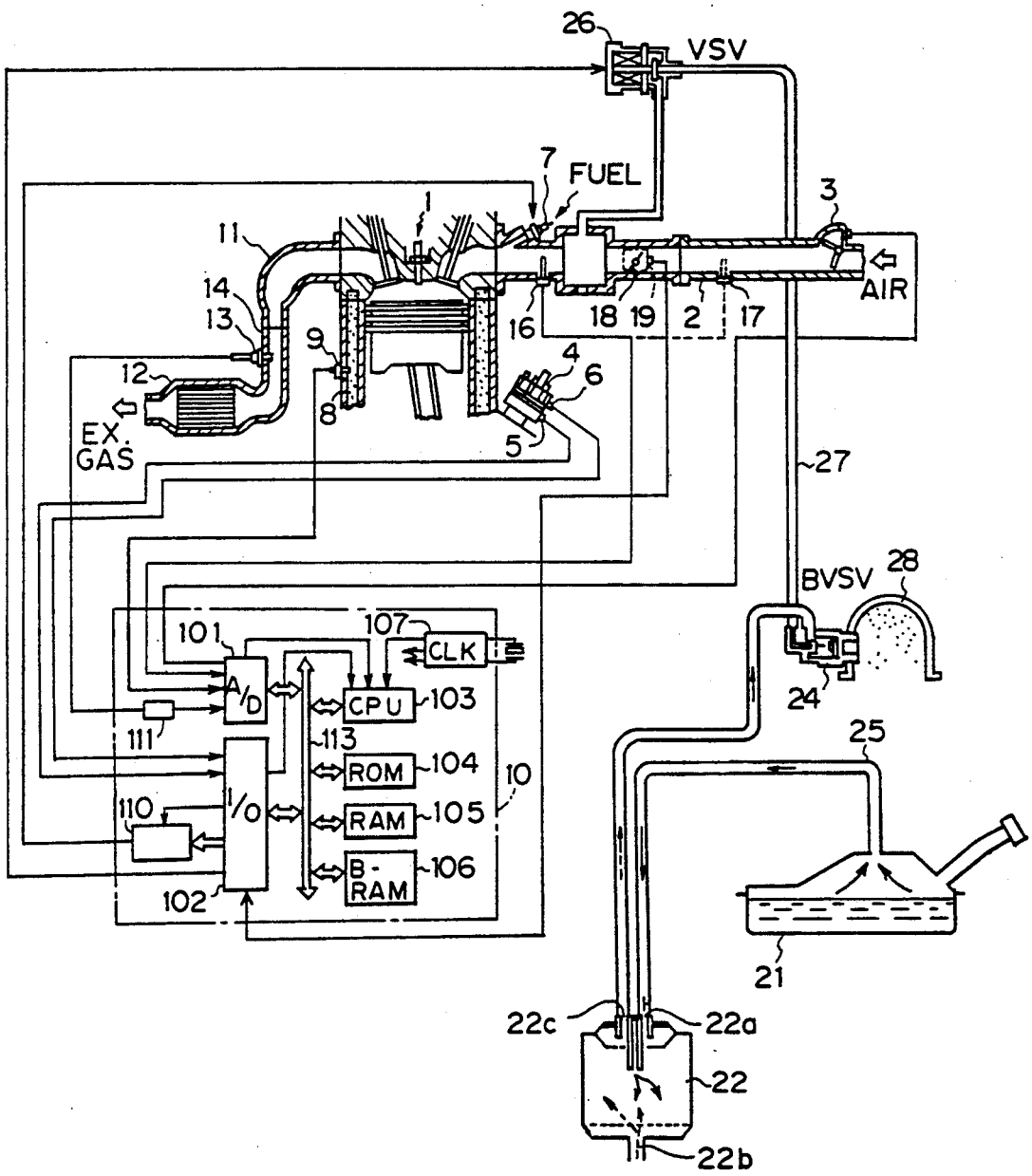
FIG. 9 is a schematic view of an internal combustion engine having an abnormal state detecting system of an evaporated emission-control system according to another embodiment of the present invention.

FIG. 9 is a schematic view of an internal combustion engine having an evaporated emission-control system abnormal state detecting system according to another embodiment of the present invention. In FIG. 9, a fuel gas sensor 16 is added between the purge port 15 and the fuel injection valve 7 in the air-intake passage, and the vapor flow switch 23 is omitted from the vapor vent pipe 25. Further, in the modified embodiment shown in FIG. 9, another fuel gas sensor 17 is added between the air flow meter 3 and the throttle valve 18 in the air-intake passage 2. The output signal of the fuel gas sensors 16 or 17 is input to the A/D converter 101 in the control circuit 10. A semiconductor-type fuel gas sensor which outputs a signal in accordance with a change of electric conductivity or heat conductivity due to an adsorption of HC gas on the surface of the semiconductor can be used for the fuel gas sensors 16 or 17.

The remaining construction shown in FIG. 9 is the same as the construction shown in FIG. 1, and thus an explanation thereof is omitted.

The operation of the control circuit 10 of FIG. 9 will be explained with reference to the flow charts of FIGS. 10 through 12.

Figure 10:
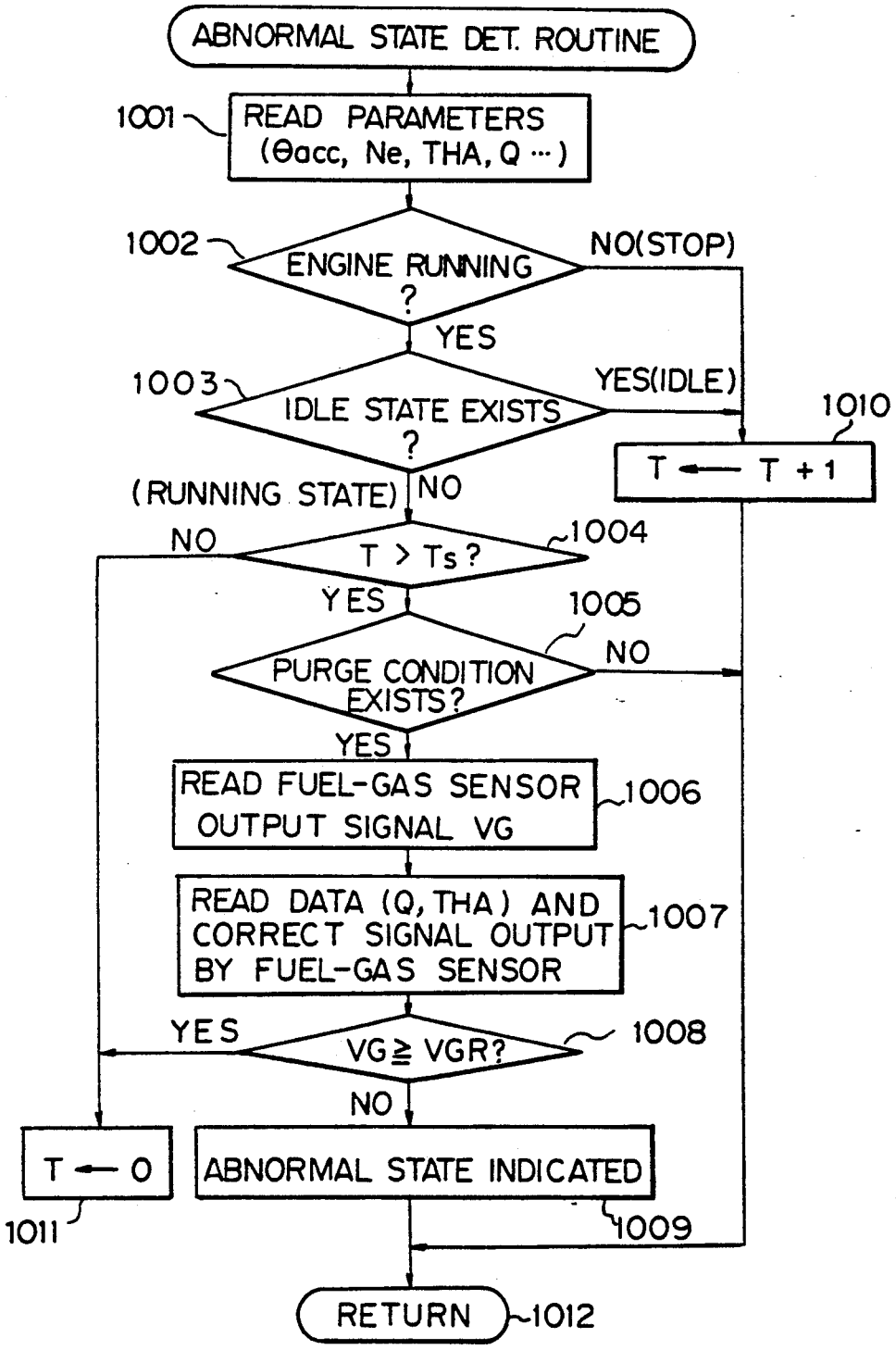
FIGS. 10 through 12 are flowcharts showing the operation of the control circuit of FIG. 9.

FIG. 10 shows a routine for detecting an abnormal state of the evaporative emission-control system, which is executed at predetermined intervals regardless of whether or not the engine is stopped.

At step 1001, a driving parameter of the engine, for example, a throttle position signal $\theta$ acc, an engine rotational speed Ne, a coolant temperature THA, and an amount of intake air is read. Then in step 1002, it is determined whether or not the engine is running, and if the engine is running the control proceeds to step 1003 and it is determined whether or not the engine is in an idle state. If the engine is in the idle state at step 1003, the control proceeds to step 1004, and if the engine is not running at step 1002 or if the engine is not in the idle state at step 1003, the control proceeds to step 1010 to increment a counter T for counting the time for which the engine is in the idle state or stop state. An amount of the value counted by the counter T is considered to be equal to an amount of fuel-vapor trapped in the canister 22. The control then proceeds to step 1012 to complete this routine.

If the engine is not in the idle state at step 1003, the control proceeds to step 1004 and it is determined whether or not the value of the counter T is larger than the predetermined value Ts. Step 1004 is used for preventing an execution of the diagnosis, whether or not the evaporative emission-control system is in an abnormal state, under the condition that the amount of fuel-vapor trapped in the canister is small. Accordingly, if $T \leqq T$ at step 1004, the control proceeds to step 1011 to reset the value of the counter T, and this routine is then completed at step 1012. In this case, the diagnosis of the evaporative emission-control system is not executed while the engine is running.

If $T > Ts$ at step 1004, the control proceeds to step 1005 and it is determined whether or not the engine is in a purge condition, i.e., whether the diagnosis conditions for the evaporative emission-control system are satisfied.

The diagnosis conditions for the evaporative emission-control system are, for example, as follows:

1) The coolant temperature is higher than 40° C.;
2) The engine is running without a fuel-cut operation;
3) The running engine is not in a transient state; and
4) The air-fuel ratio feedback control condition is satisfied.

If at least one of the above conditions is not satisfied, the control proceeds to step 1012 to end this routine, but if all of the above conditions are satisfied, the control proceeds to step 1006 to 1008 to execute the diagnosis of the evaporated emission-control system. In this way the diagnosis of the evaporated emission-control system in this embodiment is executed under the condition that a sufficient amount of fuel-vapor for a diagnosis is trapped in the canister 22.

When all of the diagnosis conditions are satisfied, the electrically-controlled purge valve (VSV) 26 is opened, and at step 1006, a signal from the fuel gas sensor 16 is read. Note, the vapor-laden air flowing into the air-intake passage 2 from the purge port 15 is diluted by air flowing from the air-flow meter 3, and thus the output characteristic of the fuel gas sensor 16 is affected by the amount of air flowing in the air-intake passage 2 and the temperature of the intake air. Accordingly, at step 1007, the amount of air-flow Q detected by the air-flow sensor 3 and the intake air temperature THA detected by the temperature sensor (not shown) are read, and then the output characteristic of the fuel gas sensor 16 is corrected by the data Q and THA. The corrected output characteristic of the fuel gas sensor 16 is VG.

If the evaporative emission-control system is in the normal state, the corrected output characteristic VG of the fuel gas sensor 16 becomes larger than the reference value VGR, and thus at step 1008, it is determined whether or not the corrected output characteristic VG of the fuel gas sensor 16 is larger than or equal to the reference value VGR. Accordingly, if $VG \geqq VGR$, the control proceeds to step 1011 to reset the counter T for counting the time for which the engine os in the idle state or stop state, and this routine is completed at step 1012. Therefore, if $VG \geqq VGR$ is once determined, the diagnosis of the evaporative emission-control system will not be executed there after until the engine is stopped.

Conversely, If the evaporative emission-control system is in the abnormal state, the corrected output characteristic VG of the fuel gas sensor 16 does not become larger than the reference value VGR. Accordingly, if $VG < VGR$, the control proceeds to step 1009 and a warning indicating an abnormal state of the evaporative emission-control system given to the driver of the vehicle. This routine is completed at step 1012.

In this embodiment, an abnormal part of the evaporative emission-control system can be assumed in accordance with the concentration of HC detected by the fuel gas sensor 16, as follows:

1) concentration of HC is 0

The vapor vent pipe 25 or the purge pipe 27 is abnormal;

2) concentration of HC is near 0

The opening **22*b*** of the canister is faulty; and

3) $0 < HC < VGR$

The adsorbent in the canister 22 is faulty.

Figure 11:
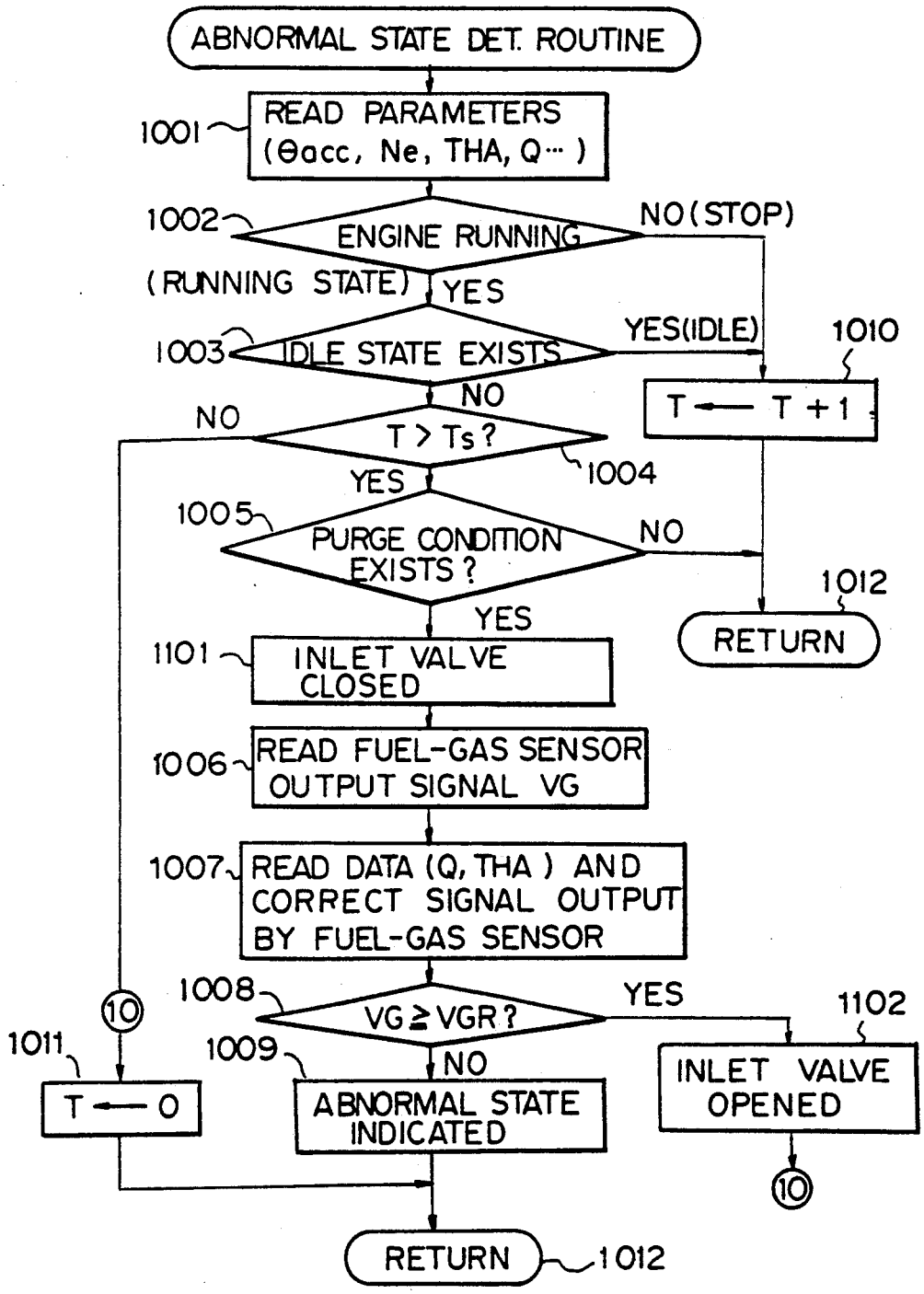

FIG. 11 and FIG. 13 are a modifications of the routine of FIG. 10. In FIG. 11, step 1101 is added between steps 1004 and 1006 and step 1102 is added between steps 1008 and 1011. In this modification, an inlet valve in the vapor vent pipe 25 is required to be closed when the purge operation is executed but it is not shown in FIG. 9. Accordingly, if all of the purge conditions are satisfied, the control proceeds to step 1101 after step 1005 and the inlet valve is closed. If the evaporative emission-control system is normal at step 1008, the control proceeds to step 1102 and the inlet valve is opened.

Figure 12:
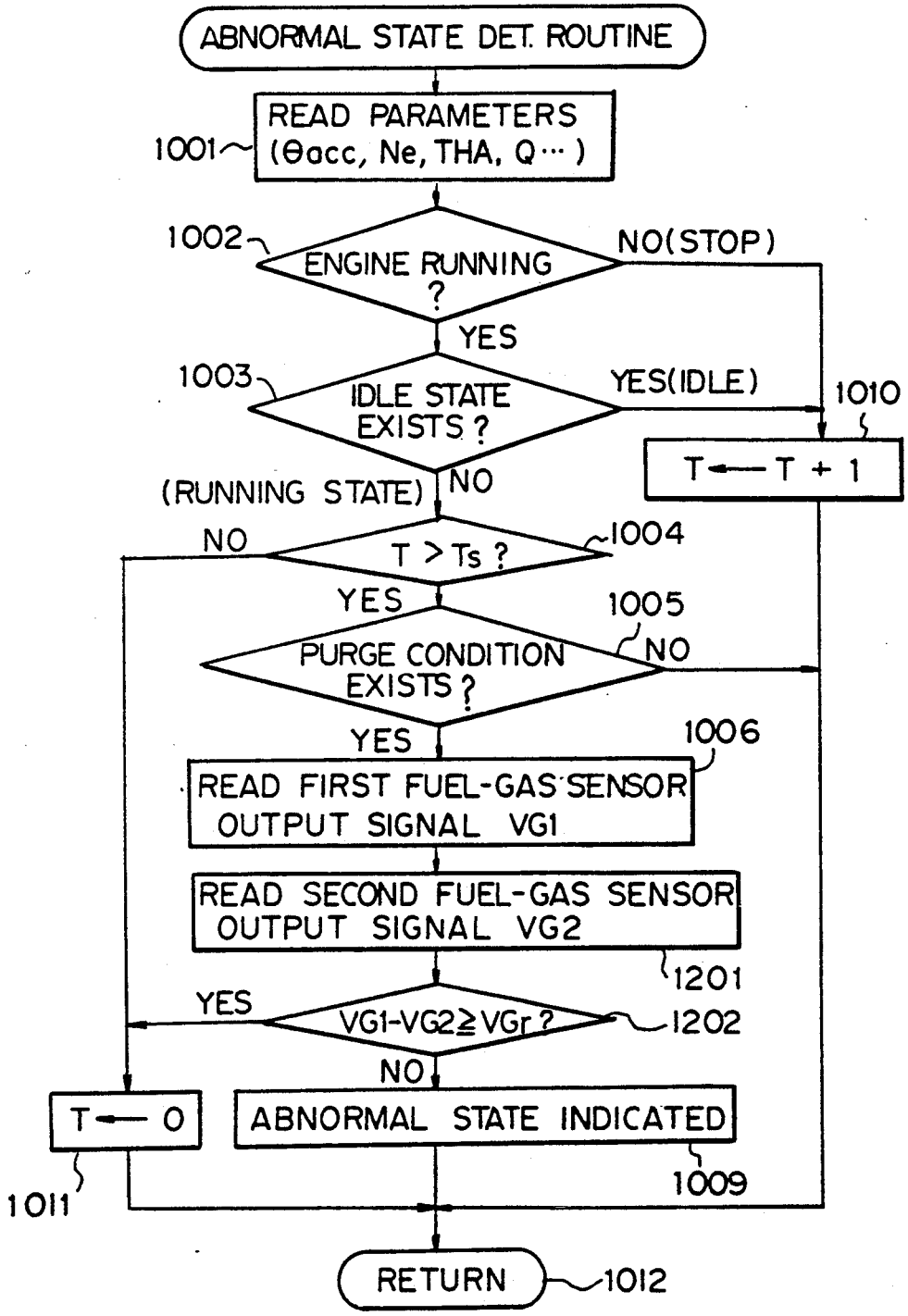

FIG. 12 is a modification of the routine of FIG. 10. In this modification, the engine is equipped with another fuel gas sensor 17 in the air-intake passage 2 upstream of the throttle valve 18. In this routine, step 1201 is executed instead of step 1007, and step 1202 is executed instead of step 1008 in FIG. 10. At step 1201, the signal VG2 from the fuel gas sensor 17 is read (the signal from the fuel gas sensor 16 at step 1006 is VG1). Note, the fuel gas sensor 17 detects the concentration of HC in the intake air, and the fuel gas sensor 16 detects the concentration in HC of the intake air after the vapor-laden air flows into the air-intake passage 2. Accordingly, the difference between the signal VG1 from the fuel gas sensor 16 and the signal VG2 from the fuel gas sensor 17 shows the concentration of HC in the vapor-laden air from the canister 22.

At step 1202, it is determined whether or not a difference between the signal VG1 and the signal VG2 is larger than or equal to the predetermined value VGr. If $VG1-VG2 \geqq VGr$, the control proceeds to step 1011 to reset the counter T for counting the time for which the engine is in the idle state or stop state, and this routine is completed at step 1012. Accordingly, if $VG1-VG2 \geqq VGr$ is once determined, the diagnosis of the evaporative emission-control system will not be executed there after until the engine is stopped. Conversely, if $VG1-VG2 < VGr$, the control proceeds to step 1009 and a warning indicating the abnormal state of the evaporative emission-control system is given to the driver of the vehicle. This routine is completed at step 1012.

What we claim is:

1. A method of detecting an abnormal state of an evaporative emission-control system in which a fuel-vapor evaporated from the fuel tank is temporarily trapped in a canister when an internal combustion engine is stopped or in an idle state, the trapped fuel-vapor is purged from the canister by a vacuum in a air-intake passage of the engine, and the purged fuel-vapor is mixed with an air-fuel mixture to be burned in a combustion chamber when a vehicle is running in a predetermined driving condition, comprising the steps of:

detecting an amount of fuel-vapor trapped in the canister, wherein the detection of the amount of fuel-vapor trapped in the canister is carried out by counting the time period for which fuel-vapor flows into the canister;

purging the fuel-vapor trapped in the canister and mixing the purged fuel-vapor with the air-fuel mixture in an air-intake passage;

detecting a concentration of a vapor-laden air from the canister when the purging is executed; and determining the occurrence of an abnormal state of the evaporate emission-control system when the amount of fuel-vapor trapped in the canister is more than a predetermined amount, purging of the fuel-vapor trapped in the canister is executed, and a change of the concentration of the vapor-laden air from the canister before and after the purging is less than a predetermined value.

2. A method as set forth in claim 1, wherein the detection of the concentration of the vapor-laden air from the canister is carried out by a fuel gas sensor disposed downstream of a purge port in the air-intake passage.

3. A method as set forth in claim 1, wherein the detection of the concentration of the vapor-laden air from the canister is carried out by a fuel gas sensor disposed downstream of a purge port in the air-intake passage.

4. A method as set forth in claim 1, further comprising the step of prohibiting an execution of a diagnosis of the evaporative emission-control system when the amount of fuel-vapor trapped in the canister is less than a predetermined amount.

5. A method as set forth in claim 4, wherein the detection of the amount of fuel-vapor trapped in the canister is carried out by counting a time for which the purging is not executed, and prohibiting a diagnosis of the evaporative emission-control system when a difference between the time for which the purging is not executed and a time for which the purging is executed is less than a predetermined time.

6. A method as set forth in claim 5, wherein the detection of the concentration of the vapor-laden air from the canister is carried out by a fuel gas sensor disposed downstream of a purge port in the air-intake passage.

7. A method of detecting an abnormal state of an evaporative emission-control system in which a fuel-vapor evaporated from the fuel tank is temporarily trapped in a canister when an internal combustion engine is stopped or in an idle state, the trapped fuel-vapor is purged from the canister by a vacuum in a air-intake passage of the engine, and the purged fuel-vapor is mixed with an air-fuel mixture to be burned in a combustion chamber when a vehicle is running in a predetermined driving condition, comprising the steps of:

detecting an amount of fuel-vapor trapped in the canister, wherein the detection of the amount of fuel-vapor trapped in the canister is carried out by counting the time period for which fuel-vapor flows into the canister;

purging the fuel-vapor trapped in the canister and mixing the purged fuel-vapor with the air-fuel mixture in an air-intake passage;

detecting a concentration of a vapor-laden air from the canister when the purging is executed; and determining the occurrence of an abnormal state of the evaporative emission-control system when the amount of fuel-vapor trapped in the canister is more than a predetermined amount, purging of the fuel-vapor trapped in the canister is executed, and the detected concentration of a vapor-laden air is smaller than the calculated concentration of a vapor-laden air in accordance with the amount of fuel-vapor trapped in the canister.

8. A method as set forth in claim 7, wherein the detection of the concentration of the vapor-laden air from the canister is carried out by a fuel gas sensor disposed downstream of a purge port in the air-intake passage.

9. A method as set forth in claim 7, wherein the detection of the concentration of the vapor-laden air from the canister is carried out by a fuel gas sensor disposed downstream of a purge port in the air-intake passage.

10. A method as set forth in claim 7, further comprising the step of prohibiting an execution of a diagnosis of the evaporative emission-control system when the amount of fuel-vapor trapped in the canister is less than a predetermined amount.

11. A method as set forth in claim 10, wherein the detection of the amount of fuel-vapor trapped in the canister is carried out by counting a time for which the purging is not executed, and prohibiting a diagnosis of the evaporative emission-control system when a difference between the time for which the purging is not executed and a time for which the purging is executed is less than a predetermined time.

12. A method as set forth in claim 11, wherein the detection of the concentration of the vapor-laden air from the canister is carried out by a fuel gas sensor disposed downstream of a purge port in the air-intake passage.

13. An apparatus for detecting an abnormal state of an evaporative emission-control system in which a fuel-vapor evaporated from the fuel tank is temporarily trapped in a canister when an internal combustion engine is stopped or in an idle state, the trapped fuel-vapor is purged from the canister by a vacuum in a air-intake passage of the engine, and the purged fuel-vapor is mixed with an air-fuel mixture to be burned in a combustion chamber when a vehicle is running in a predetermined driving condition, comprising:

means for detecting an amount of fuel-vapor trapped in the canister, wherein the detection of the amount of fuel-vapor trapped in the canister is carried out by counting the time period for which fuel-vapor flows into the canister;

means for purging the fuel-vapor trapped in the canister and mixing the purged fuel-vapor with the air-fuel mixture in an air-intake passage;

means for detecting a concentration of a vapor-laden air from the canister when the purging is executed; and means for determining the occurrence of an abnormal state of the evaporative emission-control system when the amount of fuel-vapor trapped in the canister is more than a predetermined amount, purging of the fuel-vapor trapped in the canister is executed, and a change of the concentration of the vapor-laden air from the canister before and after the purging is less than a predetermined value.

14. An apparatus as set forth in claim 13, wherein the detection of the concentration of the vapor-laden air from the canister is carried out by a fuel gas sensor disposed downstream of a purge port in the air-intake passage.

15. An apparatus as set forth in claim 13, wherein the detection of the concentration of the vapor-laden air from the canister is carried out by a fuel gas sensor disposed downstream of a purge port in the air-intake passage.

16. An apparatus as set forth in claim 13, further comprising means for prohibiting an execution of a diagnosis of the evaporative emission-control system when the amount of fuel-vapor trapped in the canister is less than a predetermined amount.

17. An apparatus as set forth in claim 16, wherein the detection of the amount of fuel-vapor trapped in the canister is carried out by counting a time for which the purging is not executed, and prohibiting a diagnosis of the evaporative emission-control system when a difference between the time for which the purging is not executed and a time for which the purging is executed is less than a predetermined time.

18. An apparatus as set forth in claim 17, wherein the detection of the concentration of the vapor-laden air from the canister is carried out by a fuel gas sensor disposed downstream of a purge port in the air-intake passage.

19. An apparatus for detecting an abnormal state of an evaporative emission-control system in which a fuel-vapor evaporated from the fuel tank is temporarily trapped in a canister when an internal combustion engine is stopped or in an idle state, the trapped fuel-vapor is purged from the canister by a vacuum in a air-intake passage of the engine, and the purged fuel-vapor is mixed with an air-fuel mixture to be burned in a combustion chamber when a vehicle is running in a predetermined driving condition, comprising:

means for detecting an amount of fuel-vapor trapped in the canister, wherein the detection of the amount of fuel-vapor trapped in the canister is carried out by counting the time period for which the fuel-vapor flows into the canister;

means for purging the fuel-vapor trapped in the canister and mixing the purged fuel-vapor with the air-fuel mixture in an air-intake passage;

means for detecting a concentration of a vapor-laden air from the canister when the purging is executed; and means for determining the occurrence of an abnormal state of the evaporative emission-control system when the amount of fuel-vapor trapped in the canister is more than a predetermined amount, purging of the fuel vapor trapped in the canister is executed, and the detected concentration of a vapor-laden air is smaller than the calculated concentration of a vapor-laden air in accordance with the amount of fuel-vapor trapped in the canister.

20. An apparatus as set forth in claim 19, wherein the detection of the concentration of the vapor-laden air from the canister is carried out by a fuel gas sensor disposed downstream of a purge port in the air-intake passage.

21. An apparatus as set forth in claim 19, wherein the detection of the concentration of the vapor-laden air from the canister is carried out by a fuel gas sensor disposed downstream of a purge port in the air-intake passage.

22. An apparatus as set forth in claim 19, further comprising means for prohibiting an execution of a diagnosis of the evaporative emission-control system when the amount of fuel-vapor trapped in the canister is less than a predetermined amount.

23. An apparatus as set forth in claim 22, wherein the detection of the amount of fuel-vapor trapped in the canister is carried out by counting a time for which the purging is not executed, and prohibiting a diagnosis of the evaporative emission-control system when a difference between the time for which the purging is not executed and a time for which the purging is executed is less than a predetermined time.

24. An apparatus as set forth in claim 23, wherein the detection of the concentration of the vapor-laden air from the canister is carried out by a fuel gas sensor disposed downstream of a purge port in the air-intake passage.

* * * * *

UNITED STATES PATENT AND TRADEMARK OFFICE

CERTIFICATE OF CORRECTION

PATENT NO. : 5,203,870

DATED : April 20, 1993

INVENTOR(S) : Nobuaki KAYANUMA, et al.

It is certified that error appears in the above-identified patent and that said Letters Patent is hereby corrected as shown below:

Column 2, line 57, between "in" and "combustion" insert --a--.

Column 4, line 22, change "a" to --an--.

Column 4, line 30, change "singals" to --signals--.

Column 6, line 40, change "opned" to --opened--.

Column 6, line 50, change "smaller" to --small--.

Column 7, line 1, change "FAFV2" to --FAFAV2--.

Column 7, line 3, change "ant" to --and--.

Column 7, line 31, change "sjtores" to --stores--.

Column 8, line 11, change "an" to --a--.

Column 8, line 44, change "Thid" to --This--.

Column 12, line 17, change "os" to --is--.

Column 12, line 42, delete "a" between "are" and "modifications".

UNITED STATES PATENT AND TRADEMARK OFFICE

CERTIFICATE OF CORRECTION

PATENT NO. : 5,203,870

DATED : April 20, 1993

INVENTOR(S) : Nobuaki KAYANUMA, et al.

It is certified that error appears in the above-identified patent and that said Letters Patent is hereby corrected as shown below:

Column 13, line 10, change "after until" to --until after--.

Column 13, line 22, change "a air-intake" to --an air-intake--.

Column 14, line 8, change "a air-intake" to --an air-intake--.

Column 14, line 64, change "a air-intake" to --an air-intake--.

Column 15, line 53, change "a air-intake" to --an air-intake--.

Signed and Sealed this

Twenty-second Day of February, 1994

*Attest:*

Bruce Lehman

BRUCE LEHMAN

*Attesting Officer*

*Commissioner of Patents and Trademarks*